US006745694B1

(12) United States Patent
Ellis et al.

(10) Patent No.: US 6,745,694 B1
(45) Date of Patent: Jun. 8, 2004

(54) METHOD AND APPARATUS FOR A SLIPSHEET REMOVAL SYSTEM

(75) Inventors: Timothy A. Ellis, Tucson, AZ (US); Randall W. Cuberly, Tucson, AZ (US); Norman L. Shaver, Tucson, AZ (US); Dean P. Stapleton, Corona, AZ (US); Paul A. Maseman, Tucson, AZ (US); Allen A. Bahr, Tucson, AZ (US); John W. Watkins, Indialantic, FL (US)

(73) Assignee: Perkinelmer, Inc., Wellesley, MA (US)

( * ) Notice: Subject to any disclaimer, the term of this patent is extended or adjusted under 35 U.S.C. 154(b) by 38 days.

(21) Appl. No.: 09/882,154

(22) Filed: Jun. 15, 2001

(51) Int. Cl.[7] ..... B41L 47/14

(52) U.S. Cl. ..... 101/477; 414/416.07; 414/752.1; 414/797; 101/480

(58) Field of Search ..... 101/477, 480; 414/416.07, 752.1, 797

(56) References Cited

U.S. PATENT DOCUMENTS 4,212,263 A * 7/1980 Hillhouse ..... 118/37
4,402,592 A * 9/1983 Schon et al. ..... 399/166
4,667,948 A * 5/1987 Angelbeck et al. ..... 271/98
5,209,809 A * 5/1993 Walter et al. ..... 347/262
5,655,452 A 8/1997 Blake et al. ..... 101/477
5,738,014 A 4/1998 Rombult et al. ..... 101/477
5,788,455 A 8/1998 Krupica et al. ..... 414/797
5,791,250 A 8/1998 Blake et al. ..... 101/483
5,809,360 A 9/1998 Blake et al. ..... 396/517
5,818,508 A * 10/1998 Straayer et al. ..... 347/262
5,992,324 A 11/1999 Rombult et al. ..... 101/477
6,000,337 A 12/1999 Blake et al. ..... 101/477
2001/0011513 A1 * 8/2001 Ono et al. ..... 101/477

FOREIGN PATENT DOCUMENTS

EP 0 822 453 A1 2/1998
EP 0 822 454 A1 2/1998
EP 0 823 664 A1 2/1998
EP 0 823 666 A1 2/1998

* cited by examiner

*Primary Examiner*—Daniel J. Colilla
(74) *Attorney, Agent, or Firm*—Christie, Parker & Hale, LLP

(57) ABSTRACT

A method for separating lightweight sheets to be discarded interleaved with heavier items to be further processed. A gas such as air is delivered by nozzles and directed at slip sheets interleaved between photosensitive plates. The slip sheets are directed by the gas to a discarded slip sheet area. An apparatus for the slip sheet removal system comprising a plate handling area and a discarded slip sheet area.

15 Claims, 7 Drawing Sheets

METHOD AND APPARATUS FOR A SLIPSHEET REMOVAL SYSTEM

FIELD OF THE INVENTION

The present invention is in the field of automated material handling for exposure systems. More particularly, the present invention provides for a method and apparatus for automatic removal of slip sheets which have been interleaved with imaging plates without the use of any physical contact between the removal mechanism and the slip sheets.

BACKGROUND OF THE INVENTION

Printing processes utilize a vast array of different technologies to transfer written content to various distribution media. One way in which content is transferred is by computer to plate (CTP) systems. The CTP process eliminates film as an intermediate transfer mechanism and allows the optical exposure of the plate directly. This reduces the number of steps required in the printing process and potentially eliminates the cost associated with the generation of the intermediate film and its handling.

In simple terms, a CTP system accepts jobs written in a page description language. These jobs are controlled through execution by priority and scheduling workflow software. Jobs are then sent through a raster image processor where the data is transformed into a raster format for printing by a digital platemaker. The platemaker system takes this data and prints it on a photosensitive coated medium, typically a sheet of aluminum coated with a photosensitive polymer, which is later notched, bent, hung on the press, inked and made ready to print on paper.

Also included in the automation of a CTP system is the media handling. It is necessary to supply plates individually from a plate supply area to the platemaker system and it is desirable to reduce the amount of operator handling involved. In CTP systems, the printing plates to be exposed possess a photosensitive coating on one side that can degrade upon prolonged exposure to a normal atmosphere and ambient light levels. Also, the photosensitive surface of the plate, typically a photopolymer, can react with the uncoated metallic side of the plate immediately above it when placed in a stack of plates. Most manufacturers of these types of printing plates attempt to minimize this surface-to-surface interaction and other degradation problems by interleaving an inert slip sheet between each printing plate. The slip sheets are sometimes coated.

These slip sheets must be removed in order for a robotic or automated system to be able to automatically load one plate at a time onto the exposure system. If the slip sheet is not removed effectively and efficiently, the slip sheets may become entangled in the system preventing plates from being transported through the system of being exposed properly and the machine and any subsequent plate development processors may jam or cease functioning.

There have been a number of previous attempts to develop effective slip sheet removal systems. In general, mechanical methods are used to physically contact the slip sheet, either with suction cups or other means of physical attachment. Prior slip sheet removal attempts have involved at least some contact between a mechanical device and the slip sheet. Because of the mechanical interaction with the slip sheet, there are many precise timing issues that must be coordinated. For instance, the slip sheet "picker" must be coordinated to interact with the plate picker so as not to interfere with it. Further, the slip sheet picker must have a method of locating the slip sheet, probably through some sort of slip sheet detection device. There is a need to precisely determine the location of the slip sheet and to make sure the slip sheet is in the correct place.

The present invention does not require any physical contact with a slip sheet. Instead, the invention uses directed gas flow to remove and discard the slip sheet into a discarded slip sheet holding bin.

SUMMARY OF THE INVENTION

The present invention provides various methods and apparatus for material handling in a context where lightweight sheets to be discarded are interleaved between heavier items to be further processed, such as in separating slip sheets that are interleaved with imaging plates. For example, the present invention provides a unique slip sheet removal system by using gas, preferably air, delivered by nozzles to direct slip sheets into a discarded slip sheet holding area or bin. More specifically, in a preferred embodiment, the invention provides for a slip sheet removal system that involves pulsing air jets which create a layer of air between the slip sheets and the plates and then directs the exposed slip sheet on the stack of plates to the holding bin. The invention also provides for an apparatus for the slip sheet removal system. More specifically, in a preferred embodiment, the invention provides for a media cart which comprises a plate handling area and a discarded slip sheet holding bin and a moving head which comprises vacuum cups, air nozzles, a baffle and other parts used to move plates from a stack to the recording area.

BRIEF DESCRIPTION OF THE DRAWINGS

The features of the present invention will be best understood from a detailed description of the invention and a preferred embodiment thereof selected for the purposes of illustration and shown in accompanying drawings in which.

DETAILED DESCRIPTION OF THE INVENTION

The present invention is directed to a method and apparatus for material handling in a context where lightweight sheets to be discarded are interleaved between heavier items to be further processed, which may, for example, be part of a larger computer to plate (CTP) imaging system. The CTP system is a complete system for plate production, where digital data files representing a publication are input to the system, and exposed plates ready to go on a printing press are output from the system. Most of the operation of the system is automated, requiring a minimum of operator intervention. The present invention in one exemplary embodiment is focused on the initial steps of a CTP process, specifically holding a stack of plates interleaved with slip sheets, removing the slip sheets from between each plate before the plate is transported to the imaging platen, and discarding the slip sheet. The CTP system in an exemplary embodiment can be configured to allow two or more plates to be processed simultaneously. Such a system is designed so that two or more stacks of plates can be set up side by side and be processed at the same time.

In a presently preferred embodiment, the invention is comprised of two major parts: (1) a media cart comprising plate storage trays and a discarded slip sheet holding bin, and (2) a movable head comprising gas actuated positioning cylinders, one or more compressed gas nozzles, and baffles configured such that when compressed air is applied, the slip sheets are removed from the stack of plates and deposited into the slip sheet holding bin. Other parts for plate picking are also included on the movable head.

Figure 1A:
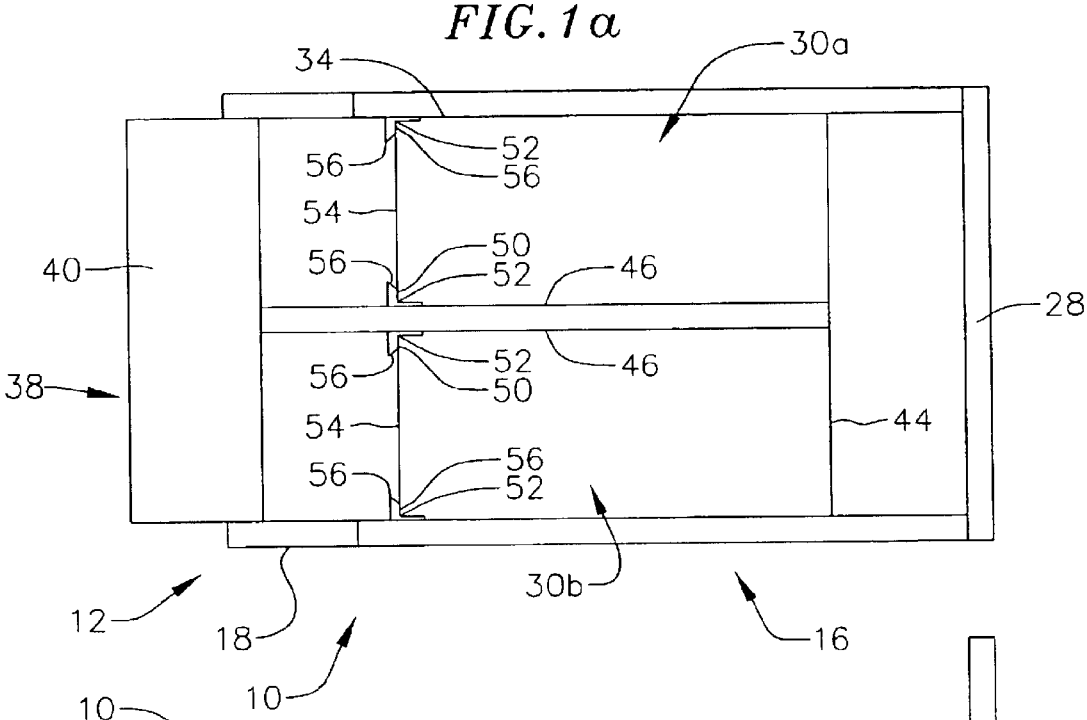
FIG. 1*a* shows a top view of a media cart according to one exemplary embodiment of the present invention.
Figure 1B:
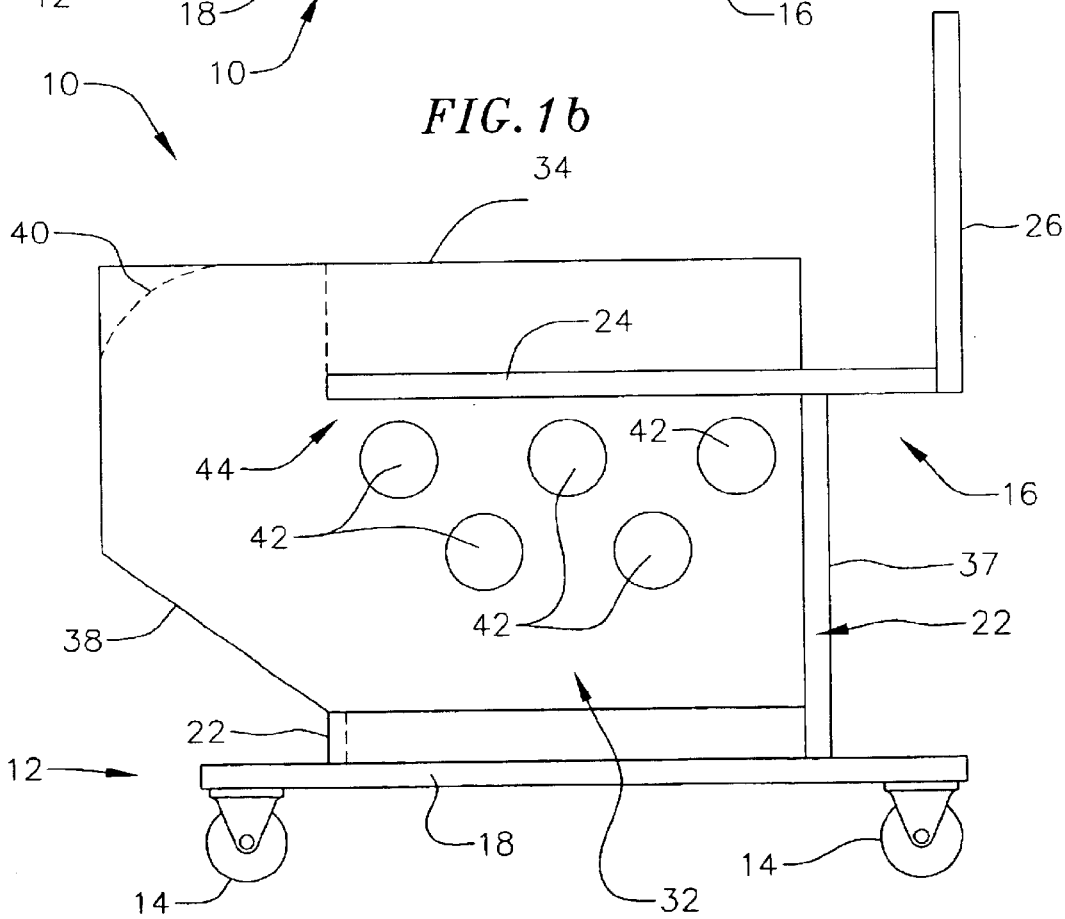
FIG. 1*b* shows a side view of the media cart.
Figure 4:
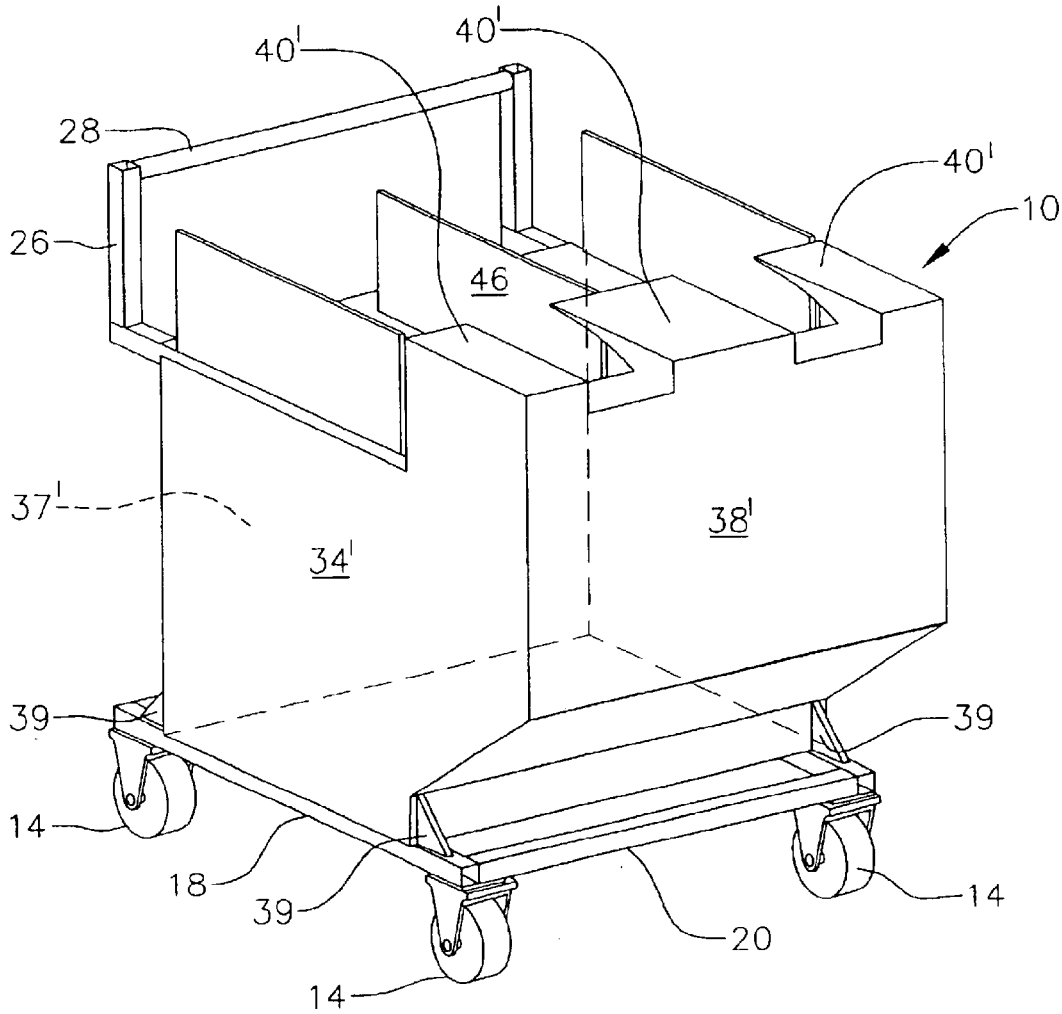
FIG. 4 shows a perspective view of an alternate embodiment of a media cart.

Embodiments of the media cart 10 are shown in FIGS. 1*a*, 1*b* and 4. The cart preferably has a base 12 having standard wheel assemblies 14 disposed thereon, preferably at the corners of the base. A frame 16 is disposed on the base.

The base preferably comprises two substantially rigid longitudinal side bars 18, preferably joined at a front portion thereof by a transverse front bar 20. The base bars 18, 20 may preferably be made from stainless steel square tubing, although any suitable other material may be used as desired. Materials suitable for this purpose would generally be any sturdy, lightweight material not susceptible to high levels of ionization or oxidation.

The frame 16 includes two pairs of upstanding side frame bars 22 extending upward from each longitudinal bar 18. At the top of each of these upstanding side frame bars are another pair of horizontal bars 24 which support a pair of vertically oriented side panels 34. At the back end of these horizontal bars 24 are two more upstanding bars 26. Top portions of these upstanding bars 26 are preferably joined by a handle 28 for handling the cart, in other words, for maneuvering and pushing the cart during the process of removing the cart from and placing the cart into the CTP machine, loading plates and unloading discarded slip sheets. The handle 28 and side frame bars 22, 24, 26 may be fabricated from stainless steel square tubing, although any suitable other material may be used as desired. Materials suitable for this purpose would generally be any sturdy, lightweight material not susceptible to high levels of ionization or oxidation.

All bars of the base 12 and frame 16 may be attached together at junctions through any suitable and conventional means such as, for example, welding, mechanical fasteners such as sleeves, nuts, bolts and/or flanges or the like.

The side panels 34 of the cart which make up the outside of the handler and the bin are supported by the frame and base bars. The side panels may be attached to the frame and base by any suitable method for attachment as specified above. The side panels may be fabricated from a suitably thin sheet metal, including, for example, stainless steel.

The base 12 and frame 16 support or carry a plate handler area 30 and a discarded slip sheet holding bin 32. The top half of the inside of the cart 10 is divided into two plate 1 handlers 30*a*, 30*b*. The plate handler area 30 is separated from the holding bin 32 by a thin 0.25 inch aluminum plate 44 which is horizontally disposed between and attached to the side panels 34 (see FIG. 1*a*). This thin plate 44 forms the bottom of the handler 30 and the top of the holding bin 32.

The inside walls of each of the handlers are smooth walls 46 that form a partition. These walls 46 are shaped at their bottom edge to attach to the plate 44 separating the handler area 30 from the holding bin 32. The width of each side of the handler is adjustable to accommodate different plate widths.

Figure 2:
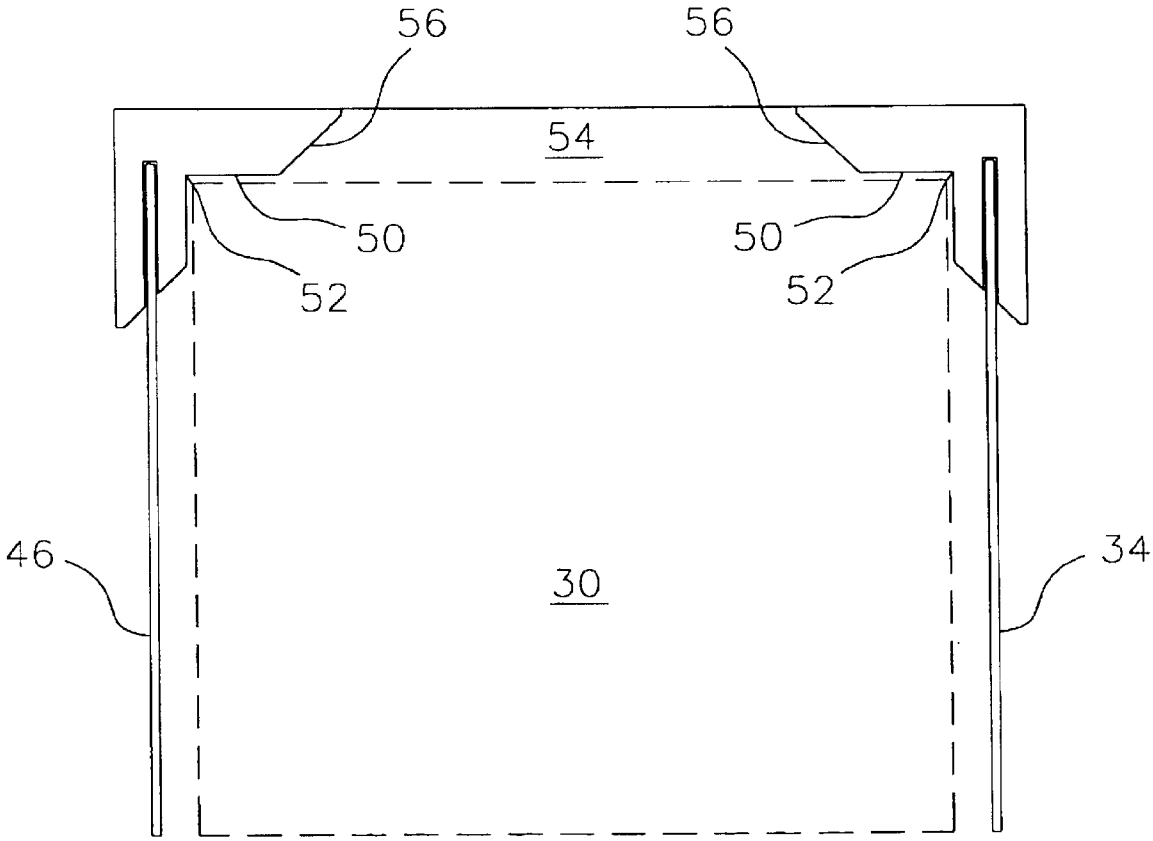
FIG. 2 shows a top view of the squared front edge of a plate handling area according to one exemplary embodiment of the present invention.

At the far front end of the inside walls 46 and outside walls 34, inwardly extending front walls 50 form square corners 52. However, the front walls taper outwardly at each side of a front opening 54. FIG. 2 shows a close up of one side of the plate handler at the front end where these corners, front walls and tapered edges 56 are located. The front edge of the partitions are supported by a groove in a small vertical post that is attached to the plate 44. The inside of the post is cut at an angle with a notch to support the corners of the printing plate stack. This tapering allows a slip sheet to more easily pass around the corners and not get caught.

The side walls 34, 46 serve two purposes. First, they create trays the size of the plates being held. They also constrain the plates when the plates are fluffed by rear gas jet nozzles to create a layer of air between the plate and the slip sheet. Second, they create a chute to direct the slip sheets into the holding bin instead of allowing them to be blown into the surrounding area.

The back 37 of the cart is a thin metal plate. The back plate is removable and is held in place by two flaps which extend inward from the back of each side wall 34. These flaps allow the back to be removed by pulling it upward. When the back plate is removed, the discarded slip sheets may be removed.

The front 38 of the bin is attached to the front side frame bars 22 and to the side panels 34 of the bin. The front may be attached to the side panels 34 and to the frame 16 by any suitable method for attachment. A suitable method for attachment would be any attachment that securely fastens the pieces together and does not allow any lateral or vertical movement. For example, welding, mechanical fasteners such as sleeves, nuts, bolts and/or flanges or the like would be acceptable.

The front of the cart 38 may be fabricated from one or more thin metal plates. It may extend up at an angle at the front end, before extending vertically to fit with the side panels 34. An angled front wall allows the discarded slip sheets to travel more evenly through to the holding bin 32 and not become piled up in the front of the cart.

Attached to the front 38 and side panels 34 at the top and front end is a rectangular panel 40 extending back horizontally. The underside of this panel 40 is concave with the concave side facing down into the holding bin. This panel 40 serves to prevent the slip sheets from being blown up and out of the cart 10, and along with the side walls 34, 46 helps direct the slip sheets into the holding bin 32.

Both side panels have circular holes 42 cut into them at the discarded slip sheet holding bin region to allow blown air to escape, rather than trapping it in the holding bin 32. Any number, shape and size of hole allowing air to flow out while constraining the slip sheets is acceptable. The sides of this region of the slip sheet bin could be made of mesh wire or expanded metal material rather than sheet metal to enable air to easily flow from the bin.

An alternate embodiment of the cart is shown in FIG. 4. In the alternate embodiment, a panel 40' attached to the front 38' and sides 34' is separated into three smaller panels as opposed to comprising one large panel extending the width of the cart. This may be done to reduce the amount of material used to build the cart. Further, in this alternative embodiment, the side panels 34' and the front panel extend down all the way to the base bars 18, 20 of the frame. Also in this alternative embodiment, the vertical and horizontal side supports 22, 24 have been removed. Finally in this alternative embodiment, triangle-shaped braces 39 have been added for additional support at each intersection of the side and front or back panels 34', 38', 37' with the horizontal base bars 18.

Thus, the media cart according to exemplary embodiments of the present invention can be loaded with two stacks of plates interleaved with slip sheets, a stack on either side of the plate handler portion of the cart. Using handle 28, the cart containing the plates to be exposed or imaged is then positioned relative to the imaging system so that the plates are accessible to that system. The interface with the imaging system is, in these exemplary embodiments, a movable head providing means for picking up a plate from the cart for delivery to the system and means for removing the slip sheets.

Figure 3:
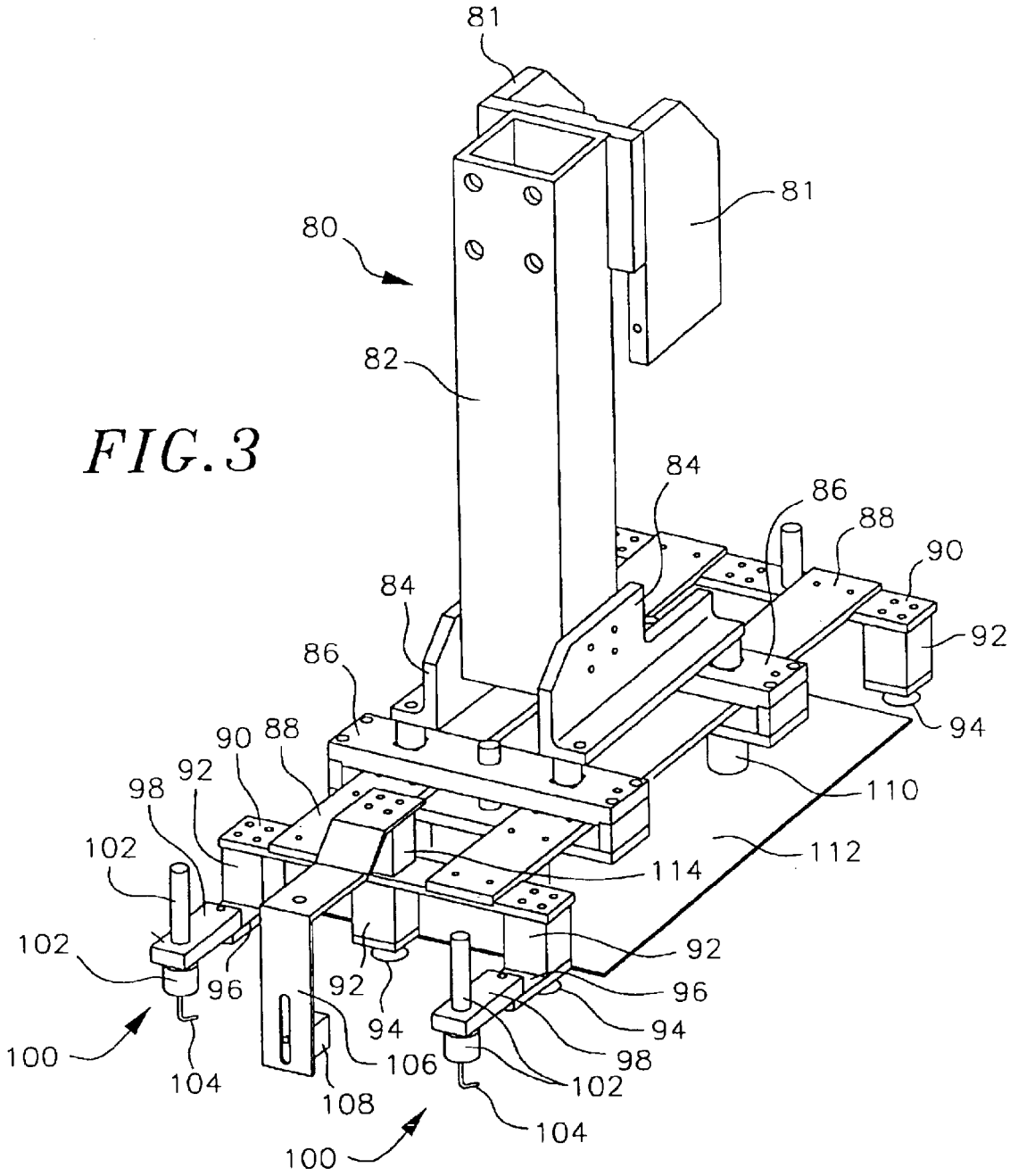
FIG. 3 shows a perspective view of a movable head according to one exemplary embodiment of the present invention.

The movable head 80 is shown in FIG. 3. The frame of the head comprises various plates, braces and cross members which provide a support structure for various attachments to the head. The head is attached to a neck 82 which connects to the imaging system. The head is attached to the neck by two shoulder support braces 84 which are screwed to the base of the neck on either side. The shoulder braces may be attached to the neck by any suitable means so as to securely position the head with respect to the neck. The neck moves the entire head 80 by lowering and raising it on a track 81, which is controlled by a motor.

The shoulder braces are in turn attached at their lower surface to two yolk plates 86 which traverse the width of the head. Attached to these yolk plates on either side are longitudinal cross members 88 which span the length of the head.

Attached at either end of each longitudinal cross member are two more yolk plates 90 which also traverse the width of the head.

Attached adjacent to the opposite outer edges of each of the yolk plates 90 is a vacuum cup body 92. Each of these four vacuum cup bodies comprise a vacuum manifold to transmit vacuum to the vacuum cup and a gas cylinder that enables the vacuum cups to be raised or lowered under computer control. Attached to the base of each of the vacuum cup bodies is a vacuum cup 94. The vacuum cup comprises a downwardly facing rubber suction cup. A vacuum is delivered to each vacuum cup through an opening in the upper surface of the cup. The vacuum may be delivered to the manifolds from a house vacuum system or suitable venturi vacuum generator. At the center of each transverse plate 90 is another vacuum cup body 92 and vacuum cup system 94 as described above.

Extending horizontally outwardly from the base of each of the vacuum cup bodies at the back end of the head is a plate extension system each comprising two plates 96, 98 connected in the center by a single screw. Plates 96 are securely attached to the frame. The screw allows the second plate 98 to be pivoted with respect to the first, allowing for lateral movement. This lateral movement allows the position of an attached jet nozzle 100 to be adjustable. The screw can be loosened to allow for vertical and pivoting movements and then tightened to hold the jet nozzles in the desired position. Fitting through a hole in each extension plate 98 is a jet nozzle 100. Each jet nozzle comprises a jet nozzle body 102 and a jet nozzle head 104. The jet nozzle body is fit through and attached to the extension plate 98. The jet nozzle head extends out of the body and ends in a narrow tube through which a gas may pass. The jet nozzle head may be bent at an angle to further focus the direction in which the gas will exit the nozzle head. The jet nozzle may also have a ball and socket joint to allow adjustment of the direction in which the nozzle points.

Attached to the center of the back transverse plate 90 is a fan nozzle support arm 106 which extends back hand then downward. This fan nozzle support arm is moved up or down by means of an air actuating cylinder 114. The support arm may be attached to the air cylinder by any suitable means which holds the parts together, for example a screws and nuts and bolts. Along the vertically disposed end of the arm 106 is an elongated vertical channel onto which a fan nozzle 108 may be attached. The fan nozzle may be attached to the arm by a means which allows it to be held in one place relative to the arm 106. However, the channel allows the placement of the fan nozzle to be adjusted vertically. The fan nozzle may be attached, for example, by a screw or nut and bolt which could be loosened and tightened to allow for placement of the fan nozzle.

Attached to the bottom of each central yolk plate 86 is a cylindrical extension tube 110. Attached to these cylindrical extension tubes is a baffle 112 which extends back to just in front of the rear vacuum cups and extends forward to just behind the front vacuum cups. The baffle also extends laterally to cover the width of the movable head. In an exemplary embodiment the front end of the baffle 112 may be slanted down. This slanted section helps direct the slip sheets into the holding bin and reduces the likelihood that slip sheets will be caught on vacuum cups 94 or jet nozzles 104. The baffle 112 may have holes cut into it to allow additional jet nozzles 100 to be placed in the middle of the head and to install any sensors needed to position the head relative to the plates.

Each nozzle is connected to a source of gas under pressure. The compressed gas is delivered to each nozzle by small, flexible tubes. The tubes are not shown in FIG. 3 for reasons of clarity. The flow of compressed gas to each of the nozzles may be controlled by solenoid valves. In an exemplary embodiment, each gas delivery tube may be connected to a source of shop air under a certain air pressure. A typical shop air pressure that will work in the exemplary embodiment is 80 psi.

The fan nozzle or air knife has a chamber for air and a slit-shaped opening about 0.125 inch in diameter from which air may exit. The slit shape forces the air out in a spread fan-shaped pattern, as opposed to a thin stream. The slit may be positioned to release air so that the long axis of the dispersion pattern is at an angle about 10° from the vertical. It is also preferably positioned to be about one inch from the back edge of the plates as they rest in the handling area. The fan nozzle is used to create an air bearing or layer of air between at least the top slip sheet and the plate beneath it. It may also begin the advance introduction of air between lower sheets and plates in the stack. Although a fan nozzle is presently preferred, any mechanism for delivering a volume of air underneath a slip sheet could be used.

The jet nozzles 102 comprise a chamber for air, and a thin spout of about 0.0625 inch or less in diameter angled from the vertical. The spout allows air to exit in a concentrated stream at high pressure. The back end jet nozzles are primarily used to break the seal between a slip sheet and the plate beneath. Although shown at a downward angle, these back end jet nozzles may be horizontal or even at a slight upward angle as long as the air stream is directed at the interface between the slip sheet and the plate. The forward jet nozzles are used to move the slip sheet and are at a downward angle and pointed generally downstream. The particular angle is not critical. Although jet nozzles are presently preferred, any mechanism for delivering a focused air stream may be used.

Figure 5A:
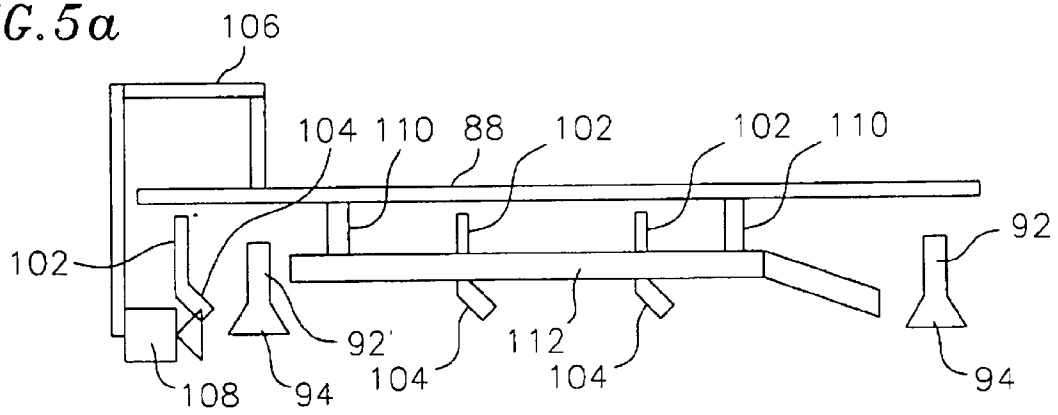
FIG. 5*a* shows a side schematic view of one exemplary embodiment of a movable head according to the present invention.
Figure 5B:
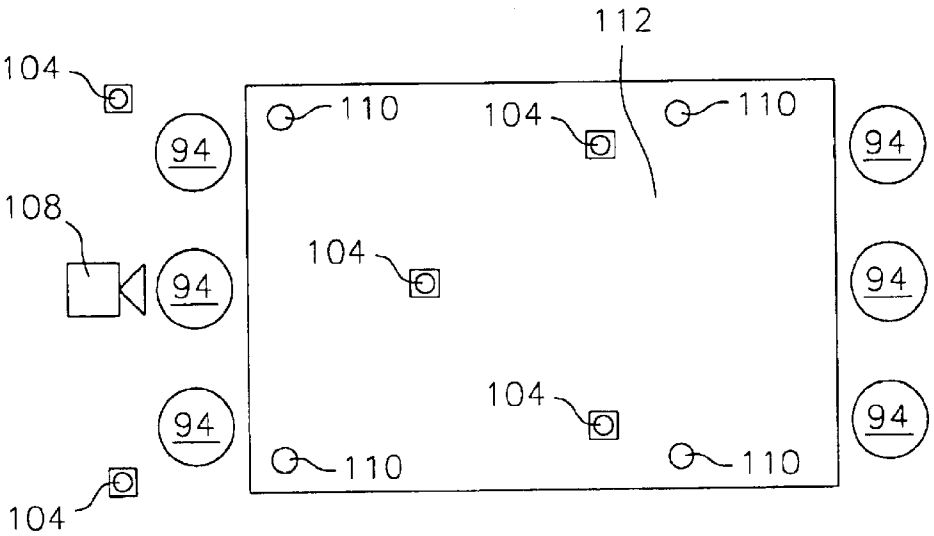
FIG. 5*b* shows a bottom schematic view of the movable head of FIG. 5*a*.

FIGS. 5*a* and 5*b* show an exemplary embodiment of the movable head of the present invention from the side and underneath respectively. As shown in FIGS. 5*a* and 5*b*, the movable head contains one fan nozzle 108 attached to the fan nozzle support arm 106. The fan nozzle support arm is attached to the longitudinal cross member (not shown). This exemplary embodiment also contains five jet nozzles (comprising a jet nozzle body 102 and head 104). Two jet nozzles are located at the back end of the movable head, substantially aligned with the fan nozzle and about 6 inches to either side of it. One jet nozzle is located about 14.5 inches in front of the fan nozzle and directly in front of it. The final two jet nozzles are located about 20 inches in front of the fan nozzle and about 4 inches to either side of it.

This exemplary embodiment contains six vacuum cups (comprising a vacuum cup body 92 and a vacuum cup 94). Located about two inches in front of the back end jet nozzles are three vacuum cups, one directly in front of the fan nozzle, and two about 4 inches to either side of it. Three other vacuum cups are located about 30 inches from the fan nozzle and in line longitudinally with the first three vacuum cups.

Figure 6A:
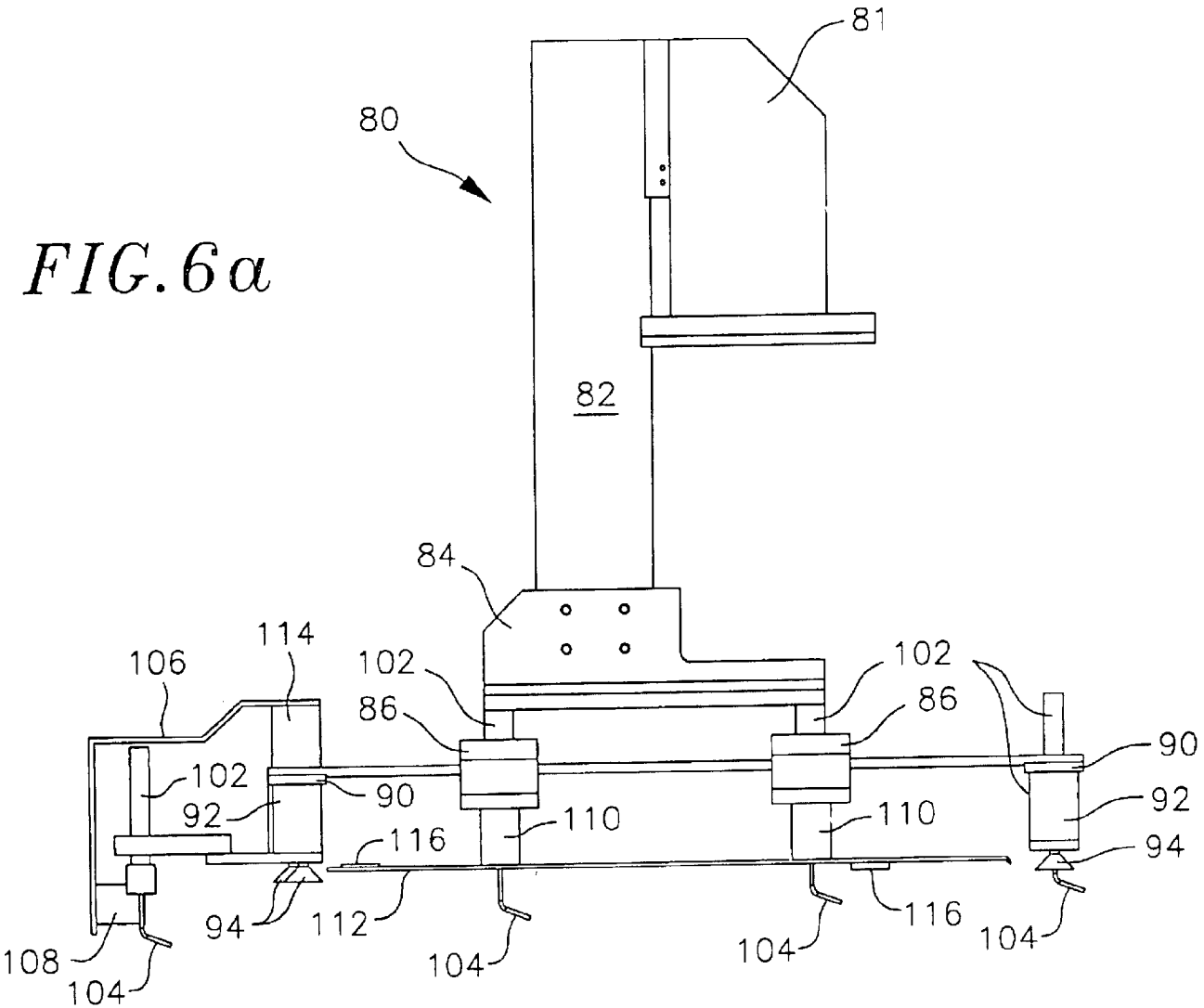
FIG. 6*a* shows a side view of another exemplary embodiment of a movable head according to the present invention.
Figure 6B:
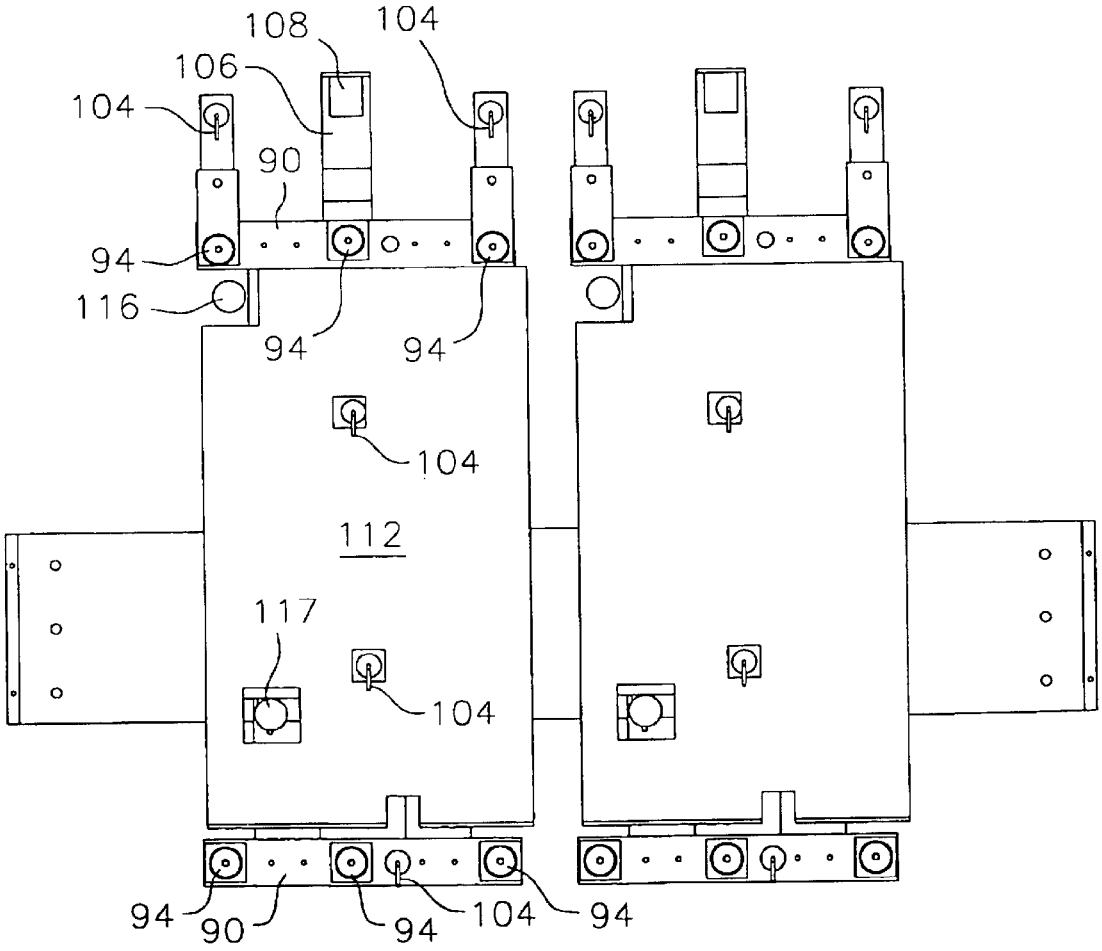
FIG. 6*b* shows a bottom view of the movable head of FIG. 6*a*.

Another exemplary, embodiment of the movable head of the present invention is shown in FIGS. 6*a*and 6*b*. FIG. 6*b* shows the double movable head that would be used with a cart having two plate handlers so that two plates can be processed at the same time. As shown in FIGS. 6*a*and 6*b*, the movable head at each of its sides contains one fan nozzle 108 attached to the fan nozzle support arm 106. The fan nozzle support arm is attached to the longitudinal cross member (not shown). This exemplary embodiment also contains five jet nozzles (comprising a jet nozzle body 102 and head 104). Two jet nozzles are located at the back end of the movable head, substantially aligned with the fan nozzle and about 6 inches to either side of it. One jet nozzle is located about 8 inches in front of the fan nozzle and directly in front of it. Another jet nozzle is located about 20 inches in front of the fan nozzle and directly in front of lit. The final jet nozzle is located about 30 inches in front of the fan nozzle and directly in front of it.

This exemplary embodiment contains six vacuum cups (comprising a vacuum cup body 92 and a vacuum cup 94). Located about two inches in front of the jet nozzles are three vacuum cups, one directly in front of the fan nozzle, and two about 4 inches to either side of it. Three other vacuum cups are located about 30 inches from the fan nozzle and in line longitudinally with the first three vacuum cups.

This exemplary embodiment also contains two photodetection sensors. The first sensor 116 is located about 3 inches in front of the fan nozzle and about 6 inches to the right of it. The second sensor 117 is located about 22 inches in front of the fan nozzle and about 5 inches to the right of it. The baffle 112 has holes cut out of it in the appropriate places to allow the sensors to detect the presence of any plates (117) and the distance to the highest plate on a stack (116).

FIG. 6*b* also shows that the two sides of the movable head are laid out in an identical manner as viewed from underneath. Although the nozzle and vacuum cup arrangements on each side are identical in this exemplary embodiment, this is not a necessary requirement. Other nozzle arrangements may be used.

In a presently preferred embodiment of the present invention: the fan nozzle used is available from McMaster-Carr, model #3404F78, the jet nozzles used are available from Pneumadyne, model #HAN-3 in which the nozzle heads are bent 90 degrees from the vertical. The vacuum cups used are available from Anver Corp., model #F25-NBR and are 25 millimeters in diameter.

The operation of a movable head will now be described. Initially, the movable head is lowered so that the vacuum cups are positioned about 0.75 inch above the top of the stack of plates. The photodetection device or sensor on the movable head informs the central processing unit (CPU) when the head is a sufficient distance from the plates. There may be two sensors on the movable head, one which detects if any plates are present and one that detects the distance between the head and the stack of plates.

Once the head is in position, the air cylinder and the attached fan nozzle are lowered. The air cylinder is lowered by air pressure which exerts a force on the lower half off the air cylinder. In its lowered position, the fan nozzle is positioned almost directly behind the top few plates on the stack of plates.

Once in a lowered position, all of the nozzles, including the fan nozzle, pulse so as to create a layer of air between the plates and the slip sheets. In other words, the nozzles turn on and turn off a certain number of times. In a preferred embodiment, the nozzles pulse three times. In another preferred embodiment, the nozzles stay on for about 0.7 seconds and stay off for about 0.4 seconds. This pulsing may not only create a layer of air between the plates and the slip sheets, but may also begin to push the top slip sheet towards the discarded slip sheet holding bin. All of the nozzles are activated during this stage of the operation merely for the sake of simplicity. All need not be activated. At least the fan nozzle and the two back end jet nozzles are preferably activated during this stage.

Once the nozzles have pulsed, the movable head may retract. In a preferred embodiment, the head may retract until there is about a 3.75 inches gap between the head and the top plate. The photodetection device on the movable head informs the CPU when the head is a sufficient distance from the plates.

Once in the retracted position, all the nozzles, including the fan nozzle, pulse again. In a preferred embodiment, the nozzles pulse twice. In another preferred embodiment, the nozzles stay on for about 1.5 seconds and stay off for about 0.5 seconds. This pulsing pushes the slip sheet into the discarded slip sheet holding bin.

Again, in this exemplary embodiment, all of the nozzles are activated at this stage merely for the sake of simplicity and they all need not be activated and they need not be activated at the same times. At least the jet nozzles are preferably activated during this stage. In an exemplary embodiment, a sensor may be used to detect whether a slip sheet has been removed. For example, a photodetector or reflectivity monitor could be mounted toward the front of the movable head to ensure the slip sheet has been pushed into the bin and to trigger additional air pulses until it has been.

Once the nozzles have pulsed, the head may again descend. In a preferred embodiment, the head may descend to a position where there is about a 0.5 inch gap between the head and the top plate. The photodetection device on the movable head informs the CPU when the head is a sufficient distance from the plates. As the head descends, the fan nozzle piston may also descend. As the head and the fan nozzle descend, all the nozzles may be turned on continuously to clear a slip sheet that may not have been pushed completely into the holding bin or may have been caught on a corner. While the nozzles are turned on, the vacuum cups may then descend to pick up the printing plate. When pressure from the compressed gas source is applied to the gas cylinders, the suction cups descend toward the top plate. When the suction cups are brought into contact with a plate, and a condition of reduced pressure is created in the vacuum manifold, the plate will be pressed against the vacuum cup and the plate may be transported.

Once the vacuum cups have picked up a plate, the head retracts and then moves forward until it rests over a vacuum platen which will take the plate to the imaging system. Once the head is substantially over the vacuum platen, the head moves the media against the indexing pins, then the vacuum cups release the plate. Although not needed for slip sheet removal, the air nozzles may be activated during movement of the plate to help lift the plate, to help keep the next slip sheet down on the stack and not adherent to the underside of the plate being moved and to make it easier to move the plate onto the platen.

Although limited embodiments of a slip sheet removal system have been described and illustrated herein, many modifications and variations will be apparent to those skilled in the art. For example, the gas used to direct slip sheets to a holding area used in an exemplary embodiment is air. However, the same effect may be achieved with other gases. In another exemplary embodiment, three pulses are used to direct the slip sheet to a holding area. However, fewer or more pulses of longer or shorter lengths may be used to achieve the same effect. For example, with coated slip sheets, which are most adherent to the plates and therefore hardest to remove, longer duration air pulses and/or more than three pulses may be desirable. The practical limit on the length and number of pulses is the desire to work within the cycle time of the imaging system for exposing the plates. In another exemplary embodiment, five jet nozzles and one fan nozzle are used to create a layer of air between the slip sheets and the plates and also to direct the slip sheet to a holding area. However, more or fewer of each kind of nozzle could be used to achieve the same effect. For example, more jet nozzles could be added at the front end of the movable head to assist in pushing a slip sheet into the bin.

From the foregoing description, it is apparent that many variations and modifications of the above described structures and procedures may be practiced without meaningfully departing from the scope of the invention. Accordingly, the foregoing description should not be read as pertaining only to the precise structures and procedures described, but rather should be read consistent with and as support for the following claims for the fullest and fairest scope.

What is claimed is:

1. An apparatus for separating slip sheets from plates comprising:

a cart comprising a plate handler area to hold at least one stack of plates interleaved with slip sheets and a discarded slip sheet holding bin;

a movable head comprising at least one vacuum cup to acquire plates one at a time from the cart;

and at least one gas nozzle to create a layer of gas between the plates and the slip sheets and to blow the slip sheets into the holding bin wherein the head comprises a chute and a top of the chute comprises a baffle.

2. An apparatus according to claim 1 wherein the baffle has an angled front edge which further guides the slip sheet into the holding area.

3. An apparatus according to claim 1 wherein plates are handled in an area defined by two side panels and a bottom plate.

4. An apparatus according to claim 3 wherein front end corners of the area are squared.

5. An apparatus according to claim 3 wherein front end corners of the area are squared and then taper off in order for the slip sheets to more easily pass through.

6. An apparatus according to claim 1 wherein the gas is air.

7. An apparatus according to claim 1 wherein the gas is at a pressure suitable for removing slip sheets and injecting air between slip sheets and plates.

8. An apparatus according to claim 1 wherein the gas is at 80 psi.

9. An apparatus according to claim 1 wherein the gas is delivered in pulses.

10. An apparatus according to claim 1 wherein one of the at least one gas nozzles is a fan nozzle.

11. An apparatus according to claim 1 wherein one of the at least one gas nozzles is a jet nozzle.

12. An apparatus according to claim 1 wherein the plate handler area holds two stacks of plates interleaved with slip sheets.

13. An apparatus according to claim 1 wherein the plate handler area is separated from the discarded slip sheet holding bin by a plate which acts as a base of the handler area and a top of the holding bin.

14. An apparatus according to claim 1 wherein a bottom front end of the cart is slanted at an outward angle to prevent discarded slip sheets from piling up at the front of the cart.

15. An apparatus according to claim 1 wherein the back of the cart is removable to allow removal of discarded slip sheets.

* * * * *